United States Patent [19]

Pauza

[11] Patent Number: 4,773,879

[45] Date of Patent: Sep. 27, 1988

[54] COAXIAL DROP CABLE

[75] Inventor: William V. Pauza, Palmyra, Pa.

[73] Assignee: AMP Incorporated, Harrisburg, Pa.

[21] Appl. No.: 107,206

[22] Filed: Oct. 13, 1987

[51] Int. Cl.[4] ..... H01R 17/18

[52] U.S. Cl. ..... 439/579; 174/88 C; 29/862; 29/867

[58] Field of Search ..... 439/578–585, 439/675, 98, 99, 322, 492, 494, 495, 497, 498, 499, 607, 608, 610, 877, 879; 174/115, 117 F, 117 FF, 71 C, 72 TR, 73 R, 75 C, 88 C; 29/857, 862, 863, 867, 828, 830, 838, 854

[56] References Cited

U.S. PATENT DOCUMENTS

| | | | |
|---|---|---|---|
| 3,280,246 | 10/1966 | Lawson et al. | 174/88 C |
| 4,157,518 | 6/1979 | McCarthy | 174/115 |
| 4,206,632 | 6/1980 | Suzuki | 174/115 |
| 4,268,714 | 5/1981 | Mori | 174/115 |
| 4,313,029 | 1/1982 | Bunish | 174/115 |
| 4,374,299 | 2/1983 | Kincaid | 174/115 |
| 4,508,415 | 4/1985 | Bunnell | 439/497 |

OTHER PUBLICATIONS

"Coax cable Connector . . . " B. Dessauer et al., vol. 9, No. 10, Mar. 1967, p. 1312.

"AMP Standard Patchcord Programming Systems", catalog No. 73–195, Rev. 4/82–AMP, Inc., pp. 17, 18, 23, 24 and front & back covers.

*Primary Examiner*—David Pirlot

*Attorney, Agent, or Firm*—Gerald K. Kita

[57] ABSTRACT

An assembly (1) of a coaxial electrical connector (2) and an electrical cable (3), wherein the cable (3) includes a drain conductor (18) and two coaxial cables (3*a*, 3*a*) within a common jacket (16), and conductive sheaths (14,14) of both coaxial cables are connected to a conductive shell (5) of the connector (2), and two signal transmitting conductors (12,12) of the two cables are connected to a center contact (10) of the connector (2) that is ordinarily suited for connection to a single coaxial cable.

12 Claims, 5 Drawing Sheets

COAXIAL DROP CABLE

FIELD OF THE INVENTION

The invention relates to an electrical cable assembly, and more particularly, to a drop cable that is used to connect a work station to a communications network wherein a number of work stations are linked by a communications cable and each work station is linked to the communications cable by a drop cable.

BACKGROUND OF THE INVENTION

A drop cable is an electrical assembly of an electrical cable and an electrical connector that facilitates electrical connection of the cable to a work station. The other end of the drop cable can be provided with another electrical connector for disconnect connection to a coaxial communications cable of a communications network. Alternatively, the other end of the drop cable can be wired directly to a coaxial communications cable to provide the connection. The drop cable provides a link between the work station and the network, whether the drop cable is directly wired to the network or is connected by an electrical connector to the network.

In one form of a network, a single coaxial cable has sufficient capacity to transmit communications signals at relatively low speed and with a low bandwidth. Each work station to be linked to the network is provided with an ordinary single coaxial jack connector through which network communications signals are both transmitted and received, and to which a drop cable must be coupled, thus to link the work station to the network. The single coaxial jack connector is commonly used to connect a single coaxial cable as a drop cable.

Not all networks make use of a single coaxial cable as a drop cable. Some networks require that a drop cable provide two separate coaxial transmission lines, one to transmit communications signals and one to receive communications signals. If a network requires a drop cable different from a single coaxial cable, the coaxial jack connector on the work station is usually of no use. The problem presented, is to adapt a drop cable of a communications network for coupling or connection with an ordinary coaxial jack connector supplied with a typical work station. Further, there is a need for a drop cable that incorporates two separate coaxial transmission lines and a drain wire, and is constructed for connection with a single coaxial plug connector. By combining the two transmission lines into a common cable jacket, the number of cables exposed to view can be reduced. Further, the cable is structured to incorporate a drain wire for connection to electrical ground potential or to some other reference electrical potential.

SUMMARY OF THE INVENTION

An aspect of the invention resides in the adapting of a drop cable for coupling with a coaxial jack connector of a workstation.

According to another aspect of the invention, a drop cable is provided as an assembly of two separate coaxial transmission lines and an electrical connector for connecting both transmission lines to a single jack connector supplied with a typical work station.

According to another aspect of the invention, a drop cable is provided as an assembly of two separate coaxial transmission lines in a single cable and a single coaxial plug connector for coupling with a single jack connector that is supplied with a typical work station.

According to another aspect of the invention, a drop cable is provided as an assembly of two separate coaxial transmission lines in a single cable and a single coaxial plug connector at one end of the cable and a different electrical connector assembly at the other end of the cable.

According to another aspect of the invention, a drop cable is provided as a single cable having two separate coaxial transmission lines and a drain wire adap&:ed for connection with a single coaxial plug connector.

Other advantages and aspects of the invention are apparent from the following detailed description taken in conjunction with the drawings.

DETAILED DESCRIPTION

Figure 1:
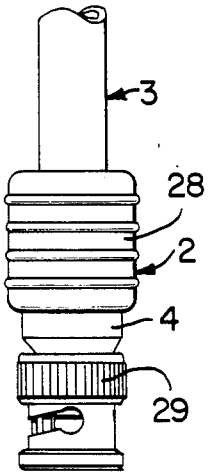
FIG. 1 is a fragmentary perspective view of an embodiment of a drop cable having an electrical connector and an electrical cable.

With more particular reference to FIG. 1, there is shown an electrical cable assembly 1 of a coaxial electrical connector 2 and an electrical coaxial cable 3. The connector 2 and cable 3 can serve as a drop cable for a communications network, not shown.

Figure 2:
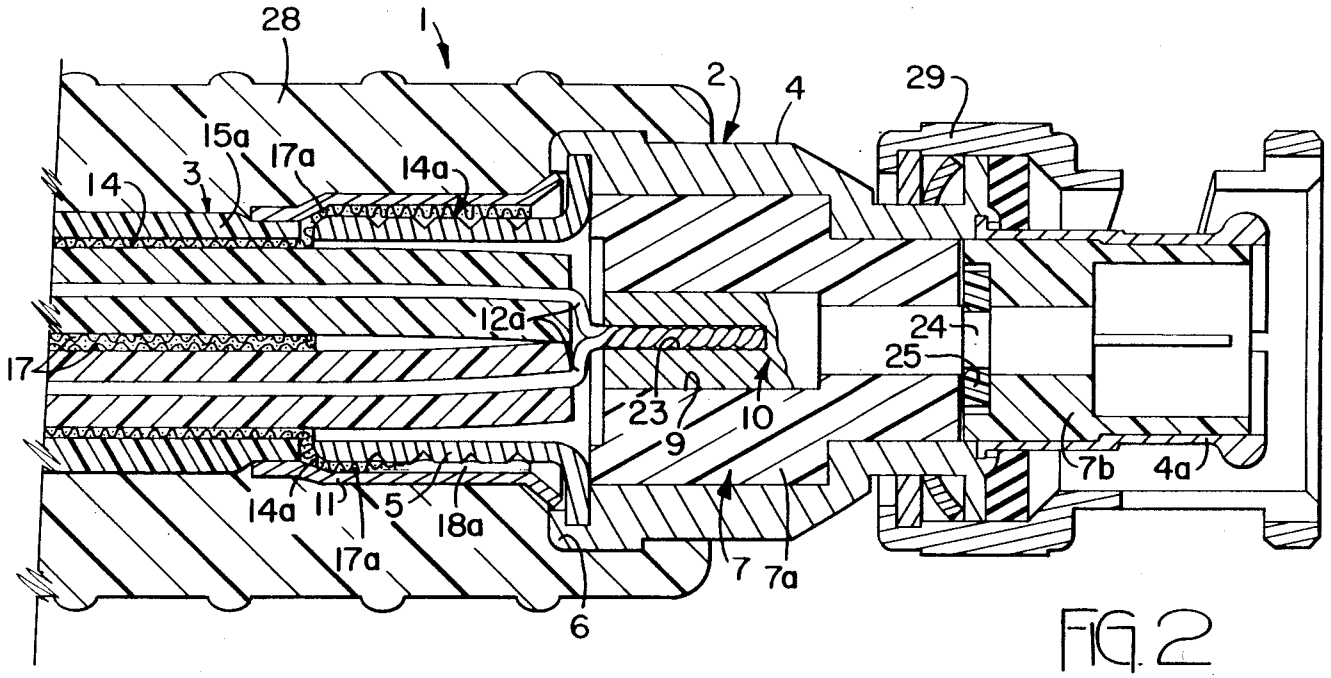
FIG. 2 is a fragmentary enlarged elevation view in section of the drop cable shown in FIG. 1.

As shown in FIG. 2, the connector 2 comprises a conductive shell 4, a conductive sleeve section or sleeve portion 5 at a rear end 6 of the shell 4, a two piece insulative body 7 with a rear portion 7*a* in the shell 4 and with a front portion 7*b* in a conductive coupling section 4*a* of the shell 4 and having a stepped axial passageway 9 communicating with the sleeve section 5, a conductive electrical contact 10 dimensioned for receipt in the passageway 9, and a conductive sleeve 11 for encircling the sleeve section 5.

Figure 3:
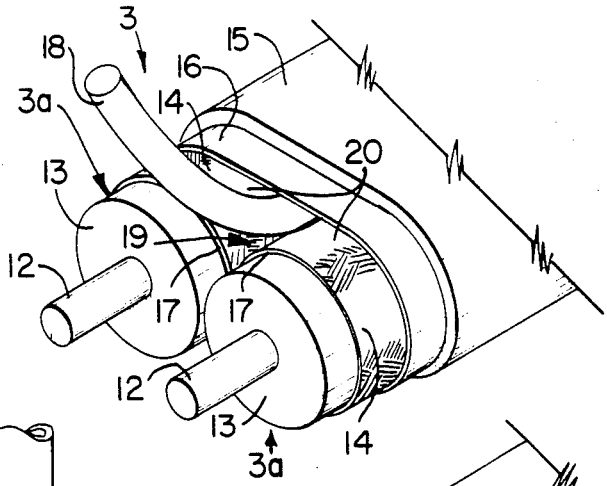
FIG. 3 is a fragmentary enlarged perspective view of an electrical cable with parts cut away to illustrate structural details of the cable.
Figure 4:
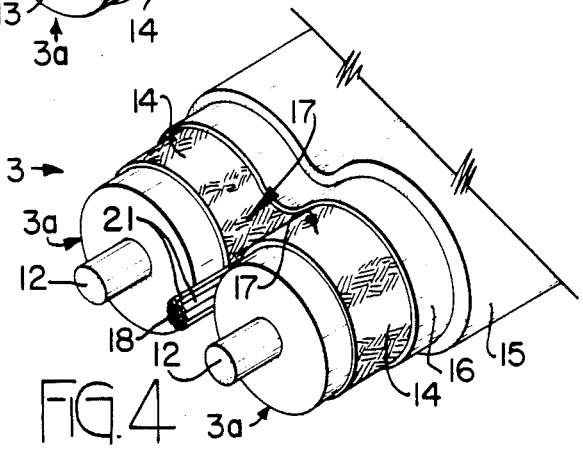
FIG. 4 is a fragmentary enlarged perspective view of another electrical cable with parts cut away to illustrate structural details of the cable.
Figure 5:
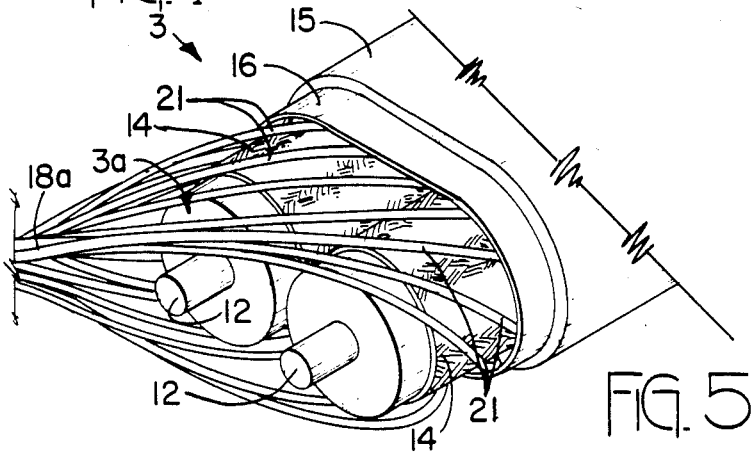
FIG. 5 is a fragmentary enlarged perspective view of still another electrical cable with parts cut away to illustrate structural details of the cable.

As shown in FIGS. 3,4 and 5 the cable 3 is a composite of two coaxial cables 3a,3a comprising a first signal transmitting conductor 12 and a second signal transmitting conductor 12, insulative layers 13,13 concentrically surrounding corresponding signal transmitting conductors 12,12, conductive sheaths 14,14 concentrically surrounding corresponding insulative layers 13,13, and an insulative jacket 15 encircling the sheaths 14,14. A thin film layer 16 of insulative material encircles corresponding sheaths 14,14. The insulative jacket 15 overlies the thin film layer 16. The thin film layer 16 resists bonding of the insulative jacket 15 to the sheaths 14,14.

The adjacent sheaths 14,14 have face to face portions 17,17 along their corresponding lengths within the insulative jacket 15. A drain conductor 18 electrically engages both conductive sheaths 14,14. The drain conductor 18 can be a solid wire engaging both conductive sheaths 14,14. The drain conductor 18 can be a single wire engaging both conductive sheaths 14,14. As shown in FIG. 3, the drain conductor 18 can be located along an interstitial space 19 along exterior surfaces 20,20 of the conductive sheaths 14,14 where the exterior surfaces 20,20 converge toward each other at the face to face portions 17,17. As shown in FIG. 4, the drain conductor 18 is adjacent to the face to face portions 17,17 of the conductive sheaths 14,14 and engages the face to face portions 17,17. The face to face portions 17,17 can engage each other along their corresponding lengths within the jacket 15, and thereby comprise face to face touching portions of the conductive sheaths 14,14. As shown in FIGS. 3 and 4 the drain conductor 18 can be interposed between and engage both the face to face portions 17,17. As shown in FIGS. 4 and 5, the drain conductor 18 can be constructed of multiple strands 21,21 of wire. Further, the multiple strands 21,21 of wire can helically encircle the conductive sheaths 14,14 as a grouped pair of sheaths.

Figure 6:
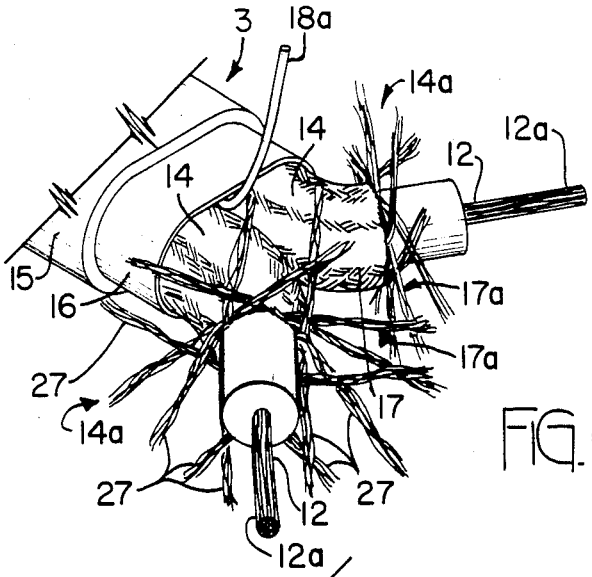
FIG. 6 is a fragmentary enlarged perspective view of the cable shown in FIG. 4, with spread apart conductive sheaths of the cable.
Figure 7:
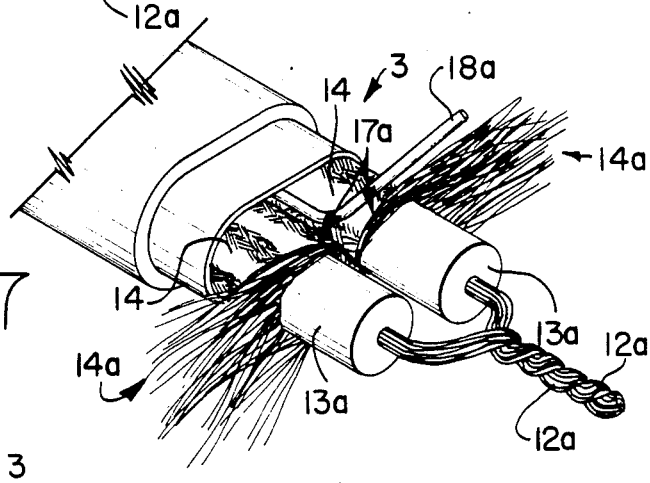
FIG. 7 is a view similar to FIG. 6 of the cable shown in FIG. 6 ready for assembly with the connector shown in FIG. 1.
Figure 8:
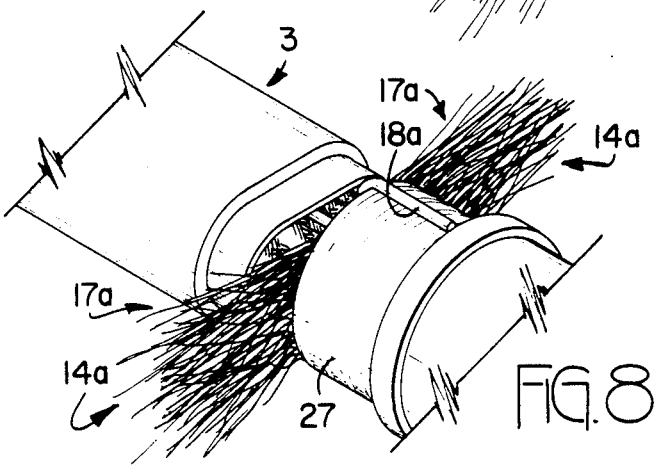
FIG. 8 is a fragmentary enlarged perspective view of the cable shown in FIG. 7 partially assembled with the connector shown in FIG. 1.
Figures 9, 10:
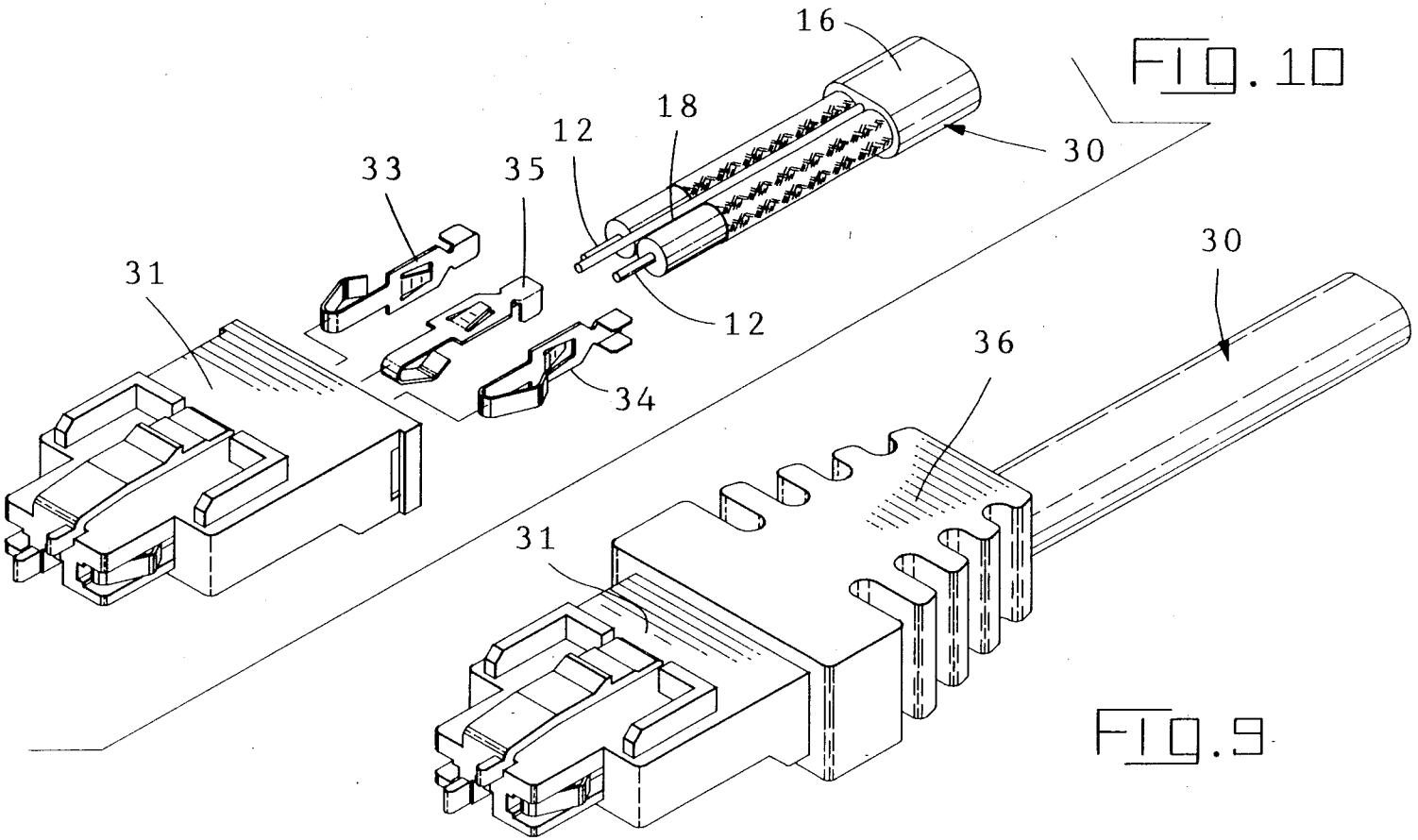
FIG. 9 is a fragmentary enlarged perspective view of a drop cable provided with an electrical connector.
FIG. 10 is a view similar to FIG. 9 with parts in exploded configuration of the drop cable and connector shown in FIG. 9.
Figure 11:
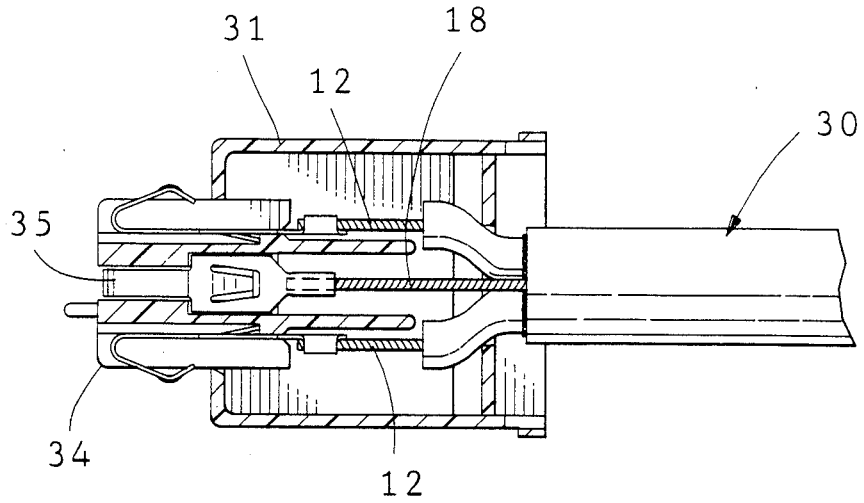
FIG. 11 is a plan view in section of the drop cable and connector shown in FIG. 9 prior to the addition of a strain relief means.
Figure 12:
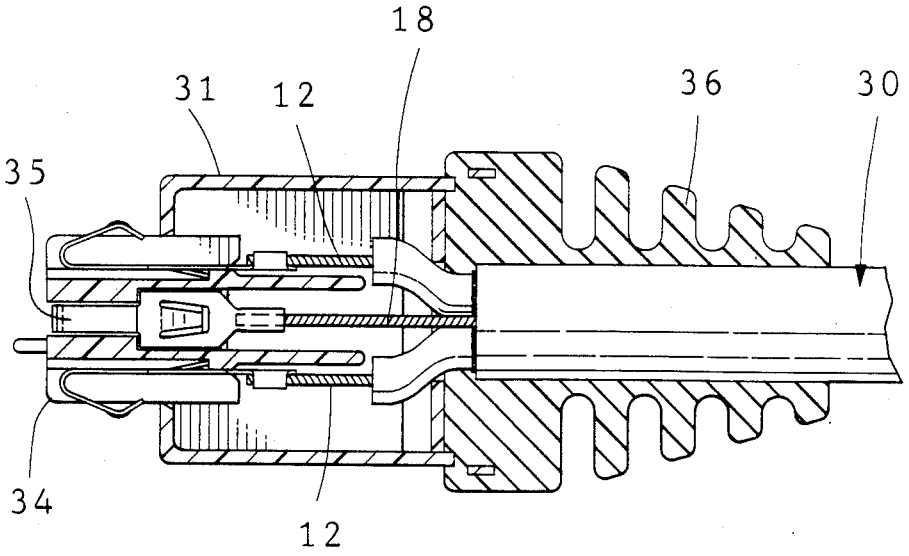
FIG. 12 is a view similar to FIG. 11 showing the drop cable and connector shown in FIG. 9 with the addition of a strain relief means.

Assembly of the cable 3 of FIG. 3 and the connector 2 is accomplished in the following manner. As shown in FIGS. 6 through 8, end portions 12a,12a of the signal transmitting conductors 12,12 are exposed by trimming off portions of the remainder of the cable 3. The end portions 12a,12a of the first and the second signal transmitting conductors 12,12 are twisted together and are conductively connected to the electrically conductive contact 10. For example, the twisted together signal transmitting conductors 12,12 are inserted in a cavity 23 communicating with a rear end 23 of the contact 10. The contact 10 and the conductors 12,12 are connected by solder, not shown, or by radially deforming the contact 10 in compression engagement with the twisted together conductors 12,12. The contact 10 has reduced diameter portion 24 on which is mounted a radially enlarged ring 25. The contact 10, together with the conductors 12,12, and the ring 25 and the insulative body portion 7a, are inserted through the conductive sleeve section 5 and the shell 4 from the rear end 6 thereof and into the passageway 9 of the insulative body 7. The ring 25 becomes axially confined in a recess in the insulative body portion 4a, and resists withdrawal of the contact 10.

An end portion 18a of the drain conductor 18 is exposed by trimming off portions of the jacket 15 and of the film layer 16 that would have covered the drain conductor 18. Similarly, end portions 14a,14a of the conductive sheaths 14,14 are exposed by trimming off portions of the jacket 15 and film layer 16 that would have covered the end portions 14a,14a of the conductive sheaths 14,14. The end portions 14a,14a of the sheaths 14,14 include end portions 17a,17a of the face to face portions 17,17 of the conductive sheaths 14,14. As shown in FIG. 5, an end portion 18a of the drain conductor 18 can be formed by the multiple strands 21,21 of wire, by twisting together exposed portions of the multiple strands 21,21.

As shown in FIG. 7, the end portions 14a, 14a of the conductive sheaths 14,14 including the end portions 17a,17a of the face to face portions 17,17 are spread out radially from the insulative layers 13,13. End portions 13a,13a of the insulative layers 13,13 of the cable 3 are exposed. The end portions 17a,17a of the face to face portions 17,17 are exposed and are also diverted, or spread out and away, from a location between the end portions 13a,13a of the insulative layers 13,13. As shown in FIG. 8, the end portions 13a,13a of the insulative layers 13,13 are assembled into the sleeve section 5 and are free of any portions of the conductive sheaths 14,14 that might enter the sleeve section 5. The end portions 14a,14a of the conductive sheaths 14,14 are also diverted from the exposed end portions 12a,12a of the signal transmitting conductors 12,12.

As shown in FIG. 6, the conductive sheaths 14,14 are constructed of braided wire strands. The wire strands are arranged in groups of untwisted wires, called wire pics 27. A number of the pics 27 are braided together to form a corresponding conductive sheath 14,14. The pics 27 are easily unbraided to free the untwisted wire strands from confinement in the corresponding sheaths 14,14. Accordingly, the end portions 14a,14a of the conductive sheaths 14,14 are readily unbraided and comprise unbraided wire strands. Similarly, the end portions 17a,17a of the face to face portions 17,17 of the conductive sheaths 14,14 comprise unbraided wire strands.

As shown in FIG. 2, the end portions 14a,14a of the conductive sheaths 14,14, including the spread out face to face portions 17a,17a, overlap the exterior of the sleeve section 5. The end portion 18a of the drain conductor 18 overlaps the exterior of the sleeve section 5. As shown in FIG. 5, in respect of the drain conductor 18 constructed of multiple strands 21,21 of wire, the multiple strands 21,21 can be twisted together to provide an end portion 18a of the drain conductor 18 prior to overlapping the end portion 18a of the drain conductor 18 on the sleeve section 5 of the shell 4. The conductive sleeve 11, that has been assembled to encircle the cable is traversed along the cable 3 and into position encircling the end portions 14a,14a of the conductive sheaths 14,14 and encircling the sleeve section 5. A suitable tool, not shown, applies radial pressure on the sleeve 11 to deform the sleeve 11 radially. The conductive sleeve 11 radially compresses the end portions 14a,14a of the conductive sheaths 14,14 and the end portion 18a of the drain conductor 18 against the sleeve section 5 to establish an electrical connection. Any excess lengths of the end portions 14a,14a of the conductive sheaths 14,14 or of the end portion 18a of the drain conductor 18 are then cut off. To complete the assembly, an insulative strain relief means 28 is applied to surround and grip the conductive sleeve 11, the end 6, and the jacket 15 of the cable 3. The strain relief means 28 includes insulative material applied by moulding operation and surrounding and adhered to the conductive sleeve 11 and an end portion 15a of the insulative jacket 15 of the cable 3. The connector assembly 1 is a plug type connector and includes a rotatably mounted bayonet type coupling ring 29 and is suitable for connection with a coaxial jack, not shown, that is supplied with a work station, not shown. Thereby, the assembly 1 is a drop cable that adapts two coaxial cables *3a,3a* for connection to an ordinary coaxial connector 2 that usually connects to only one coaxial cable.

The cable 3 extends from the conductive shell 4 to a cable end 30, which can be hard wired, or direct wired, to a network communications cable, not shown. The end of the cable 3 that is not connected with the connector 2 has utility, because the corresponding ends of the wires and conductors, not shown, of the cable 3 can be joined directly to corresponding wires of the network without using a connector. The expressions, hard wiring, and, direct wiring, are utilized in the electrical industry and refer to an electrical connection established by joining electrically conductive wires directly together. For example, wires can be directly connected together by twisting the wires on one another, followed by soldering the wires to produce a solder joint of the wires. Alternatively, the cable 3 extends from the conductive shell 4 to a connector assembly 31 as shown in FIGS. 9 through 12, having an insulative housing 32 and three electrical contacts 33,34,35 spaced apart in the housing 32 and connected respectively to the signal transmitting conductors 12,12 and the drain conductor 18. A strain relief means 36 is applied to the housing 31 and the cable end 30. The strain relief means 36 may comprise insulative material applied, for example, by a moulding operation to adhere to the housing 31 and the cable end 30.

I claim:

1. An assembly of a coaxial electrical connector and an electrical cable, wherein the connector comprises a conductive shell, a conductive sleeve section of the shell at a rear end of the shell, an insulative body in a front end of the shell and having an axial passageway communicating with the sleeve section, and a conductive electrical contact dimensioned for receipt in the passageway, and wherein the cable comprises a first and a second signal transmitting conductor, insulative layers concentrically surrounding corresponding signal transmitting conductors, conductive sheaths concentrically surrounding corresponding insulative layers, the sheaths having face to face portions along their corresponding lengths, and an insulative jacket surrounding the sheaths, the improvement comprising;

a drain conductor electrically engaging both conductive sheaths, the first and the second signal transmitting conductors being twisted together and conductively connected to the contact, end portions of the face to face portions of the conductive sheaths extending over the exterior of the sleeve section, end portions of the conductive sheaths including end portions of the face to face portions of the conductive sheaths being spread out radially from the insulative layers, said end portions of the conductive sheaths overlapping the exterior of the shell, and a conductive sleeve radially compressing the end portions of the conductive sheaths and an end of the drain conductor against the sleeve section to establish an electrical connection.

2. An electrical connector assembly as recited in claim 1, wherein, the conductive sheaths are constructed of braided wire strands, and the end portions of the conductive sheaths are unbraided wire strands, and the end portions of the face to face portions of the conductive sheaths are unbraided wire strands.

3. An electrical connector assembly as recited in claim 1, wherein, the cable extends from the conductive shell to a connector assembly having an insulative housing and three electrical contacts spaced apart in the housing and connected respectively to the signal transmitting conductors and the drain conductor.

4. An electrical connector assembly as recited in claim 1, wherein, strain relief means includes insulative material surrounding and adhered to the conductive sleeve and an end of the insulative jacket of the cable.

5. An electrical connector assembly as recited in claim 1, wherein, the drain conductor is adjacent to the face to face portions of the conductive sheaths.

6. An electrical connector assembly as recited in claim 1, wherein, the drain conductor engages the face to face portions of the conductive sheaths.

7. An electrical connector assembly as recited in claim 1, wherein, the drain conductor is constructed of multiple strands of wire, and end portions of the multiple strands of wire are twisted together to form the end portion of the drain conductor.

8. An electrical connector assembly as recited in claim 1, wherein, the face to face portions of the conductive sheaths comprise touching portions of the conductive sheaths.

9. A method for terminating a coaxial cable having two signal transmitting conductors concentrically encircled by corresponding insulative layers, conductive sheaths encircling concentrically corresponding insulative layers, the sheaths having face to face portions, a drain conductor engaging the conductive sheaths and an insulative jacket surrounding the drain conductor and the conductive sheaths, comprising the steps of;

exposing end portions of the signal transmitting conductors, end portions of the conductive sheaths, an end portion of the drain conductor and end portions of the insulative layers from an end portion of the insulative jacket, twisting together end portions of the signal transmitting conductors and connecting the twisted together end portions of the signal transmitting conductors with a single conductive electrical contact of an electrical connector, diverting end portions of the face to face portions of the conductive sheaths from the exposed end portions of the signal transmitting conductors in a conductive shell of the electrical connector, spreading out end portions of the conductive sheaths including end portions of the face to face portions of the conductive sheaths from the insulative layers, assembling the electrical contact and the twisted together end portions in an axial passageway of an insulative body in the shell, overlapping the end portions of the conductive sheaths together with the end portion of the drain conductor on an exterior of the shell, assembling a conductive sleeve on the end portions of the conductive sheaths and the end portion of the drain conductor, and making an electrical connection of the conductive sleeve, the end portions of the conductive sheaths, the end portion of the drain conductor and the exterior of the shell.

10. A method as recited in claim 9, wherein the conductive sheaths are constructed of braided together wire strands, and further including the step of; unbraiding the wire strands of the end portions of the conductive sheaths prior to overlapping the end portions of the conductive sheaths on the exterior of the shell.

11. A method as recited in claim 9, and further including the steps of; extending the cable a desired distance from the conductive shell to a connector assembly having an insulative housing and three electrical contacts spaced apart in the housing, and connecting electrically the three electrical contacts, respectively, to the signal transmitting conductors and the drain conductor.

12. A method as recited in claim 9, wherein the drain conductor is constructed of multiple strands of wire, and further including the steps of; twisting together multiple strands of the drain conductor to provide an end portion of the drain conductor prior to overlapping the end portion of the drain conductor on the shell.

* * * * *